US005305724A

United States Patent [19]

Chikamatsu et al.

[11] Patent Number: 5,305,724

[45] Date of Patent: Apr. 26, 1994

[54] EVAPORATIVE FUEL CONTROL UNIT FOR INTERNAL COMBUSTION ENGINE

[75] Inventors: Masataka Chikamatsu; Shigetaka Kuroda; Kazutomo Sawamura; Toshihiko Sato; Takayoshi Nakayama, all of Tochigi, Japan

[73] Assignee: Honda Giken Kogyo Kabushiki Kaisha, Tokyo, Japan

[21] Appl. No.: 20,404

[22] Filed: Feb. 22, 1993

[30] Foreign Application Priority Data

Feb. 28, 1992 [JP] Japan ..... 4-075912

[51] Int. Cl.[5] ..... F02M 37/04

[52] U.S. Cl. ..... 123/520; 123/198 D

[58] Field of Search ..... 123/516, 518, 519, 520, 123/198 D, 521

[56] References Cited

U.S. PATENT DOCUMENTS

| | | | |
|---|---|---|---|
| 4,949,695 | 8/1990 | Uranishi | 123/198 D |
| 5,158,054 | 10/1992 | Otsuka | 123/198 D |
| 5,172,672 | 12/1992 | Harada | 123/198 D |
| 5,191,870 | 3/1993 | Cook | 123/520 |
| 5,193,512 | 3/1993 | Steinbrenner | 123/198 D |
| 5,205,263 | 4/1993 | Blumenstock | 123/520 |
| 5,216,998 | 6/1993 | Hosoda | 123/520 |

*Primary Examiner*—Carl S. Miller

*Attorney, Agent, or Firm*—Nikaido, Marmelstein, Murray & Oram

[57] ABSTRACT

Disclosed is an evaporative fuel purging apparatus used for an internal combustion engine. A canister having an absorbing agent for absorbing an evaporative fuel generated in a fuel tank of the internal combustion engine is provided. A drain control valve is provided on a drain port for opening the canister to the atmospheric air, and which is adapted to open and close the drain port. A purge control valve is provided on a purge passage communicating the canister to a part of an intake system, and which is adapted to purge the evaporative fuel absorbed into the canister through opening and closing the purge passage. A diagnostic device diagnoses the presence or absence of leakage in a purge system which is sealed up by closing the drain control valve and the purge control valve after pressure-reduction treatment. In the above apparatus, the drain control valve is opened after termination of the diagnosis by the diagnostic device, to open the canister to the atmospheric air through the drain port, and after an elapse of a specified time, the purge is started by opening the purge control valve. With this construction, it is possible to prevent the rapid change in the air-fuel ratio in re-starting the purge after termination of the diagnosis for the purge system, and hence to improve the stabilization of the emission and the drivability.

4 Claims, 6 Drawing Sheets

EVAPORATIVE FUEL CONTROL UNIT FOR INTERNAL COMBUSTION ENGINE

FIELD OF THE INVENTION

The present invention relates to an internal combustion engine, and particularly to a control unit used for an evaporative fuel purging apparatus including an abnormality diagnostic means.

BACKGROUND OF THE INVENTION

In an evaporative fuel purging apparatuses used for an internal combustion engine in which an evaporative fuel generated in an fuel tank is absorbed by an absorbing agent of a canister; the evaporative fuel thus absorbed is released from the absorbing agent with the intake of the air; and the evaporative fuel is supplied (purged) to an intake system through an purging passage, abnormalities of the purging system can be diagnosed by such a process as follows.

After the pressure-reduction treatment for the purge system, both a drain shut-off valve provided on a drain port for sucking the atmospheric air in a canister and a purge cut valve provided in a purge passage are closed to form an enclosed space, and thereby the abnormality diagnosis for the purge system is performed by checking the leak down. Namely, when there occurs a leakage due to gaps generated in the piping connections, valves, seals or the like in the closed purge system, the tank internal pressure is greatly increased, which is diagnosed to be abnormal.

After termination of such an abnormality diagnosis for the purge system described above, if the purge cut valve is opened while closing the drain shut-off valve or simultaneously opening the same to perform the purge control of the evaporative fuel again, the fuel vapor with high concentration, which has remained during leak down check in the canister and the purge tube which are pressure-reduced in a state where the evaporative fuel is liable to be generated, is purged in the intake system at a stretch. This causes the rapid change in the air-fuel ratio, thereby bringing the deterioration in the emission and drivability.

Taking the above circumstances into consideration, the present invention is made, and its object is to provide an evaporative fuel control unit used for an internal combustion engine capable of preventing the rapid change in the air-fuel ratio after abnormality diagnosis for the purge system, thereby securing the stabilization of the emission and the drivability.

SUMMARY OF THE INVENTION

To achieve the above object, according to the present invention, there is provided an evaporative fuel purging apparatus used for an internal combustion engine, comprising: a purge system comprising a fuel tank and a canister, the canister having an absorbing agent for absorbing an evaporative fuel generated in the fuel tank, and a drain control valve provided on a drain port for opening the canister to the atmospheric air, which is adapted to open and close the drain port; a purge control valve provided on a purge passage communicating the canister to a part of an intake system of the internal combustion engine, and which is adapted to control purge of the evaporative fuel absorbed into the canister through the purge passage; a diagnostic device for diagnosing the presence or absence of leakage in the purge system which is sealed up by closing the drain control valve and the purge control valve; and a purge control device for inhibit purging evaporative fuel until a predetermined time elapses after opening of the drain control valve.

In the present invention, after termination of the diagnosis by the diagnostic device, first, the drain control valve is opened to open the canister to the atmospheric air, and when the evaporative fuel generated in the canister has been absorbed by the absorbing agent again to be stabilized after an elapse of a specified time, the purge control valve is opened to start the purge. Consequently, it is possible to prevent the rapid change in the air-fuel ratio, and hence to secure the stabilization of the emission and the drivability.

The specified waiting time after opening the drain control valve is set to be longer with an increase in generation of the evaporative fuel according to operational conditions of the engine. Consequently, it is possible to effectively prevent the rapid change of the above air-fuel ratio.

DETAILED DESCRIPTION OF THE PREFERRED EMBODIMENT

Figure 2A:
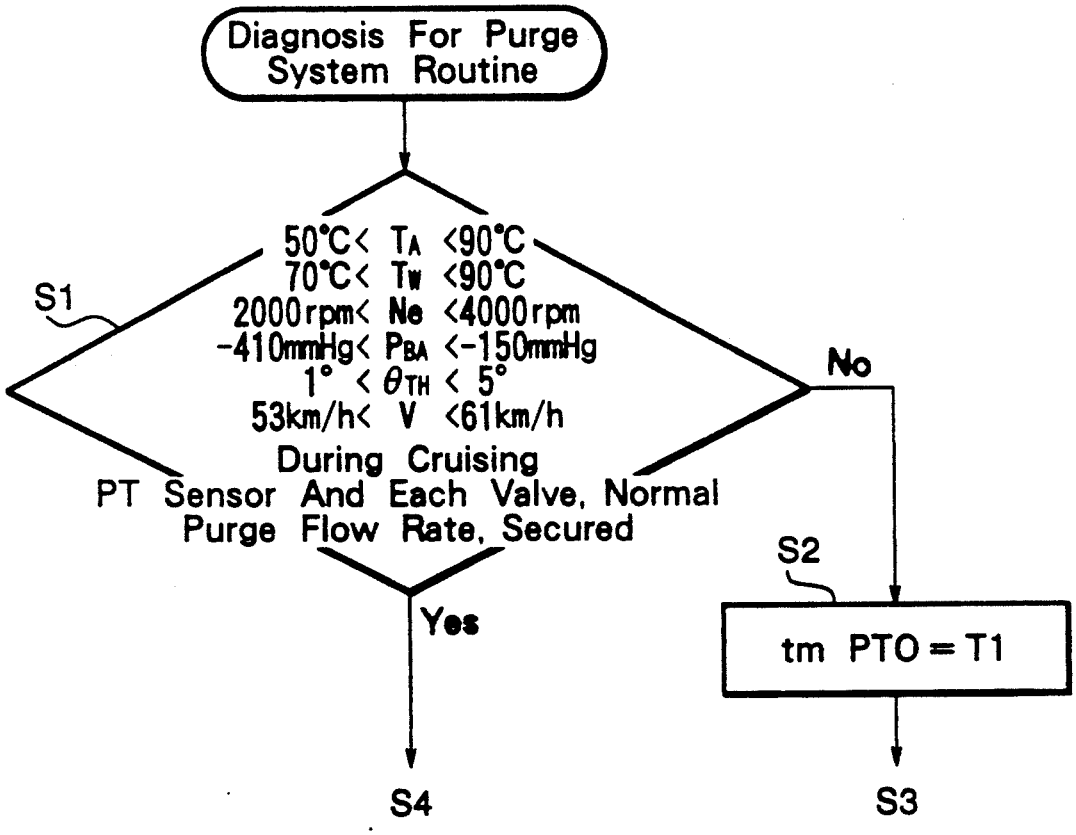
FIGS. 2A, 2B and 2C are flow charts showing a diagnostic routine of a purge system.
Figure 2B:
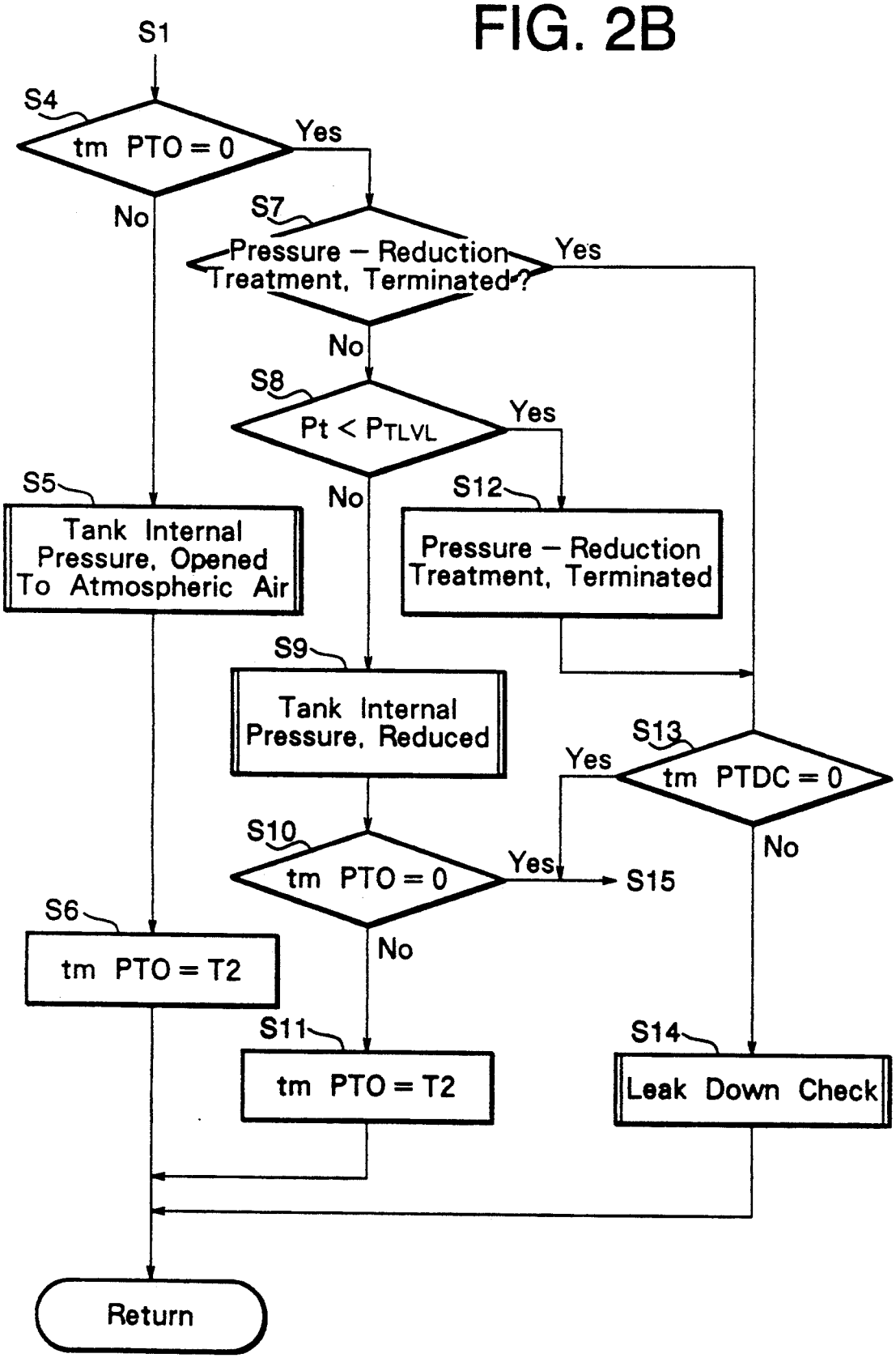
Figure 2C:
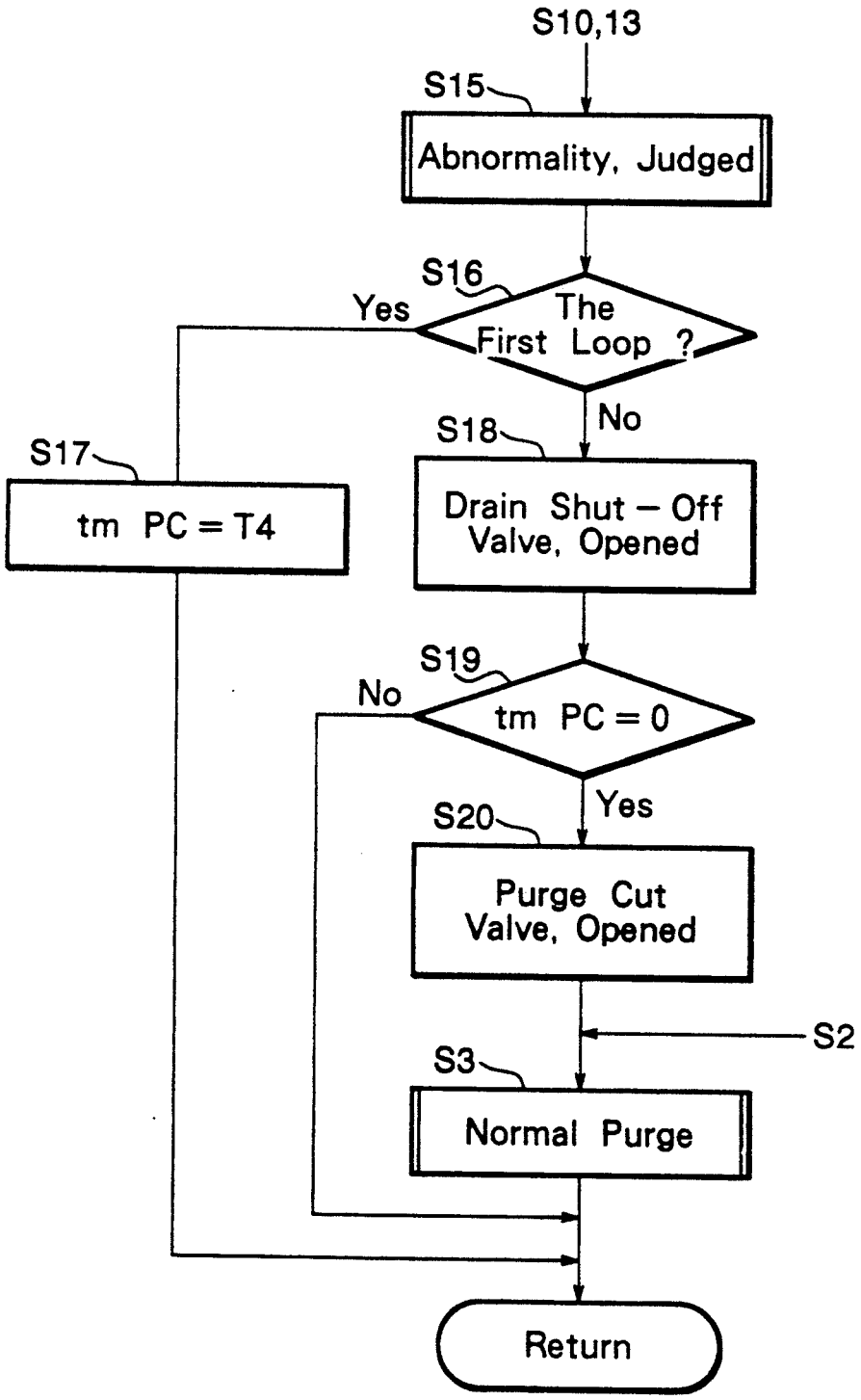
Figure 3:
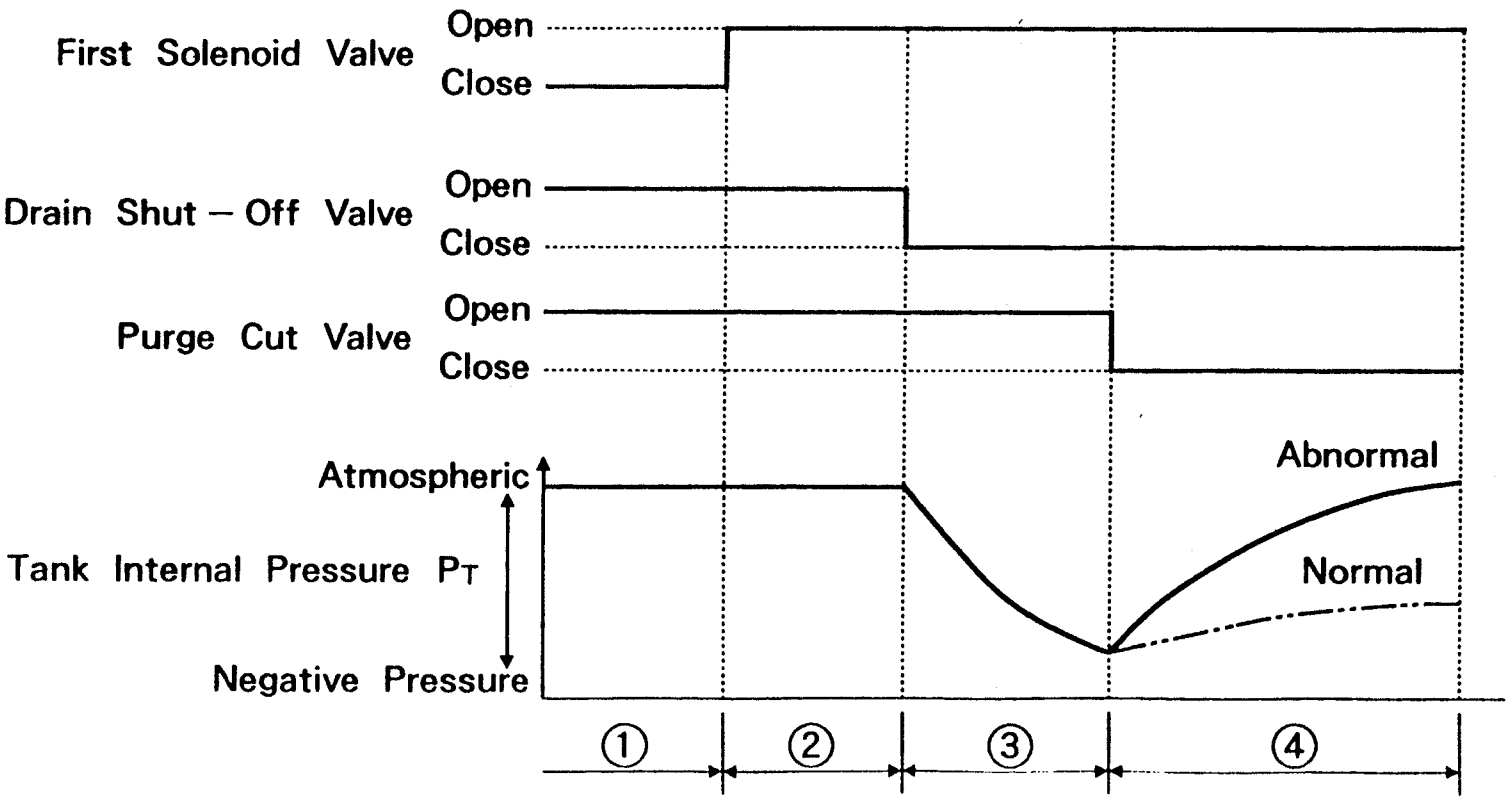
FIG. 3 is an explanatory view for the control in the flow chart of FIG. 2.

Hereinafter, an embodiment of the present invention will be described with reference to FIGS. 1 to 3.

Figure 1:
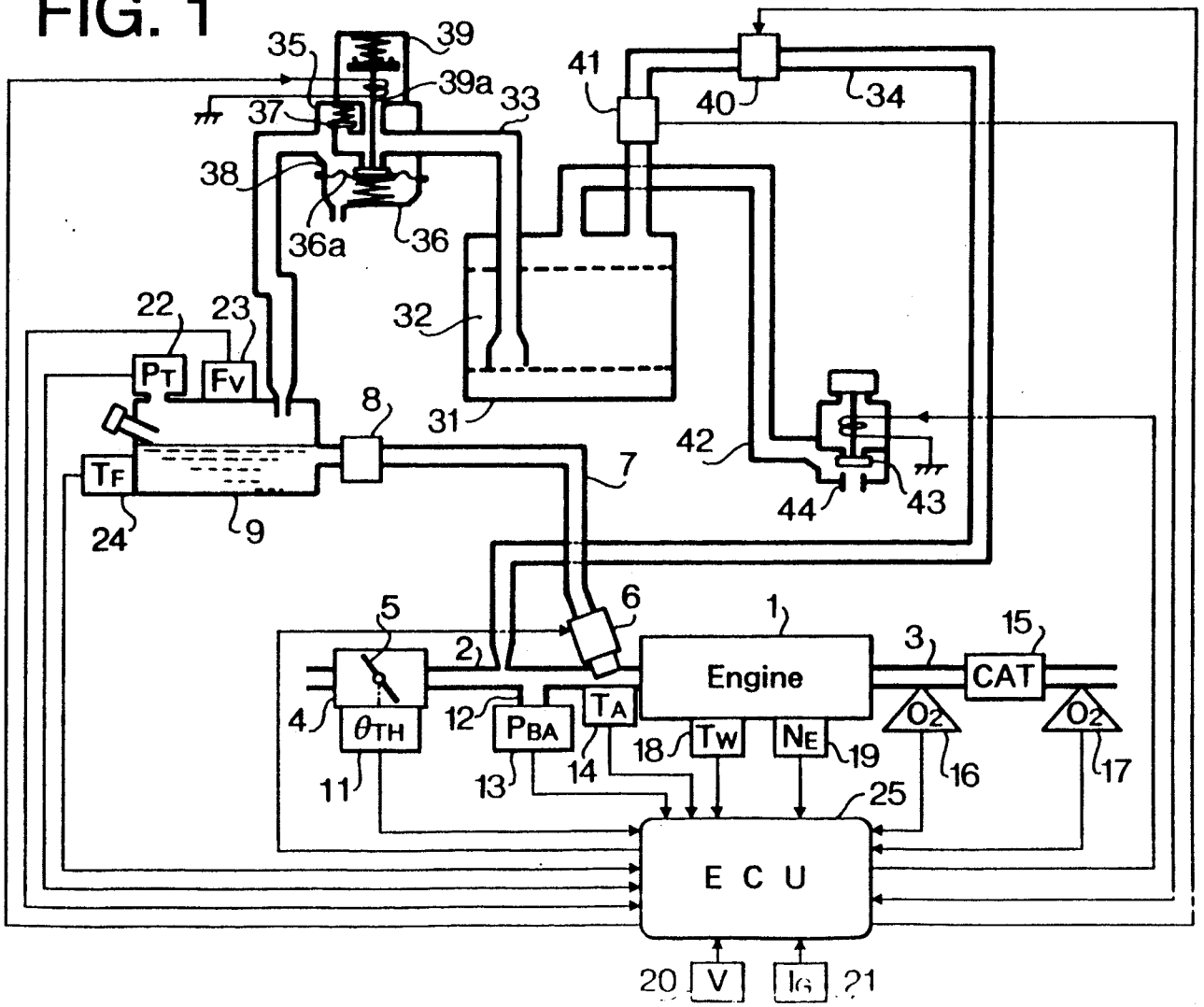
FIG. 1 is a view showing the whole construction of a fuel supply control unit according to an embodiment of the present invention.

FIG. 1 is a view showing the whole construction of a fuel supply control unit used for an internal combustion engine according to this embodiment. As shown in FIG. 1, an engine 1 is such an internal combustion engine as to suck an air-fuel mixture from an intake tube 2, to obtain a power by combustion, and to discharge the exhaust gas after combustion through an exhaust tube 3.

A throttle body 4 is formed on the way of the intake tube 2, and which internally includes a throttle valve 5. A fuel injection valve 6 is provided on the downstream side from the throttle valve 5 and on the somewhat upstream side from an intake valve (not shown) of the engine 1. The fuel injection valve 6 is connected to a fuel pump 8 through a fuel supply tube 7 for supplying the fuel stored in a fuel tank 9 to the intake system.

In such an intake system, a throttle valve opening sensor 11 detects a valve opening $\theta_{TH}$ of the throttle valve 5; an absolute pressure sensor 13 provided in a branch tube 12 branched from the intake tube 2 detects an absolute pressure $P_{BA}$ in the intake tube 2; and an intake air temperature sensor 14 provided on the downstream side of the intake tube 2 detects an intake air temperature $T_A$.

On the other hand, in the exhaust system, a three way catalytic converter 15 is provided on the way of the exhaust tube 3 for purifying the exhaust gas from the engine 1 through a three way catalyst and discharging it. On the upstream and downstream sides from the three way catalytic converter 15, $O_2$ sensors 16 and 17 for detecting oxygen concentration in the exhaust gas are disposed, respectively.

Also, in the engine 1, an engine coolant temperature sensor 18 composed of a thermistor is provided on the peripheral wall of a cylinder in a cylinder block filled with a coolant for detecting a coolant temperature $T_W$. Further, an engine rotational speed sensor 19 is mounted around a cam shaft or a crank shaft (not shown) of the engine 1 for detecting an engine rotational speed $N_e$.

A car velocity sensor 20 detects a car velocity V, and an ignition switch sensor 21 detects the on-state of an ignition switch $I_G$ showing that the engine 1 is in the operation condition. Also, the fuel tank 9 includes a tank internal pressure sensor 22 for detecting a tank internal pressure $P_T$, a fuel amount sensor 23 for detecting a fuel amount $F_V$, and a fuel temperature sensor 24 for detecting a fuel temperature $T_F$.

Each of detected signals from the above sensors 11, 13, 14, 16 to 24 is input in an electronic control unit ECU 25, to be offered to each control.

Next, an evaporative fuel purging apparatus will be described. A canister 31 is filled with an activated charcoal 32 therein. The inside of the activated charcoal 32 is communicated to an upper space of the fuel tank 9 through a vapor tube 33. Further, the upper space of the canister 31 is communicated to the downstream side from the throttle valve 5 of the above intake tube 2 through a purge tube 34.

A first control valve 35 is interposed in the vapor tube 33, and which includes a two-way valve 38 composed of a positive pressure valve 36 and a negative pressure valve 37, and a first solenoid valve 39 additionally provided so as to be integrated with the two-way valve 38. Namely, the leading edge of a rod 39*a* of the first solenoid valve 39 is abutted on a diaphragm 36*a* of the above positive pressure valve 36.

When the solenoid of the first solenoid valve 39 is energized, the diaphragm 36*a* is forcibly opened by the rod 39*a*, and the first control valve 35 is opened to make the vapor tube 33 in the communication state. Meanwhile, in the deenergized state of the solenoid of the first solenoid valve 39, the opening/closing operation of the first control valve 35 is controlled by the two-way valve 38.

Furthermore, a purge cut valve 40 serving as a second control valve is interposed in a conduit of the purge tube 34. The purge cut valve 40 is composed of a solenoid valve and is controlled in its opening/closing operation by the ECU 25.

In addition, a hot-wire flow meter 41 is disposed on the upstream side from the purge cut valve 40 of the purge tube 34 for detecting the mass flow $Q_{HW}$ of an air-fuel mixture containing the evaporative fuel flowing in the purge tube 34.

Also, a drain tube 42 extends from a drain port opened at the upper portion of the canister 31, and a drain shut-off valve 43 is interposed between the drain tube 42 and an atmospheric air introducing port 44. The drain shut-off valve 43 is composed of a solenoid valve and is controlled by the ECU 25 in its opening/closing operation. When the solenoid is in the deenergized state, the drain shut-off valve 43 is opened, to thereby supply the atmospheric air from the atmospheric air introducing port 44 to the upper space of the canister 31. On the contrary, in the energized state of the solenoid, the drain shut-off valve 43 is closed, to thereby shut-off the communication of the atmospheric air to the upper space of the canister 31.

In the fuel supply control unit of the engine 1 as described above, the ECU 25 receives respective detected signals from the sensors, and determines various operational states, such as the feedback control operational area according to the oxygen concentration in the exhaust gas and the open-loop control area in fuel cut and in high load; and calculates an opening time $T_{OUT}$ of the fuel injecting valve 6 synchronized with a TDC signal pulse from the above engine speed sensor 19 on the basis of a specified equation, thereby controlling the fuel supply amount to keep the air-fuel ratio at an optimal value.

Hereinafter, a method for diagnosing the evaporative fuel purging system in the above fuel supply control unit will be described with reference to the flow chart of FIGS. 2A, 2B and 2C and the explanatory view of FIG. 3.

First, it is determined whether or not the operational state of the engine is suitable to carry out the abnormality diagnosis for the purge system (step S1). Namely, it is discriminated whether or not the intake air temperature $T_A$ is within a specified range (for example, 50° C.$<T_A<$90° C.), and the engine coolant temperature is within a specified range (for example, 70° C.$<T_W<$90° C.), so that it is determined whether or not the engine is in a warming up state. Next, it is discriminated whether or not the engine rotational speed $N_e$ is within a specified range (for example, 2000 rpm$<N_e<$4000 rpm), the absolute pressure $P_{BA}$ in the intake tube is within a specified range (for example, $-410$ mmHg$<P_{BA}<-150$ mmHg), the throttle valve opening $\theta_{TH}$ is within a specified range (for example, $1° < {}_{TH} < 5°$), the car velocity V is within a specified range (for example, 53 km/h$<$V$<$61 km/h), and the car running is in the cruising state, so that it is determined whether or not the operational state is in a stable cruising state. The cruising state is determined by, for example, whether or not the car velocity change within $\pm$0.8 km/sec is continued for 2 seconds.

Next, it is discriminated whether or not the tank internal pressure sensor 22 and the valves are normally operated, and whether or not the mass flow $Q_{HW}$ passing through the purge tube 34 detected by the hot-wire flow meter 41 is sufficiently secured.

If either of the discriminations in the step S1 results in "No", it is determined that the engine operational state is not suitable to carry out the abnormality diagnosis for the purge system, and thus the flow advances to a step S2. If all of the discriminations in the step S1 result in "Yes", it is determined that the engine operational state is suitable to carry out the abnormality diagnosis of the purge system, and thus the flow advances to a step S4.

Hereinafter, referring to FIG. 3, the description will be made in accordance with the flow chart of FIG. 2. FIG. 3 is a view showing the operational patterns of the first solenoid valve 39, drain shut-off valve 43, and the purge cut valve 40, and the change state of the tank internal pressure $P_T$ which have four stages of: ① normal operation, ② atmospheric opening, ③ pressure-reduction treatment, and ④ leak down check.

Directly after engine starting, the engine is not in the operational state allowing carrying out detection of the abnormality of the purge system. Accordingly, the flow advances from the step S1 to the step S2, in which a first timer ${}_{tm}$PTO is set to be a first predetermined time T1. The specified time T1 is set at a time period (for example, 30 sec.) required to stabilize the tank internal pressure $P_T$ opened to the atmospheric air.

After starting the first timer $_{tm}$PTO, the flow advances to a step S3, in which the evaporative fuel purge system is set at the normal purge mode. Namely, the first solenoid valve 39 is closed, so that the vapor tube 33 is automatically controlled in its opening/closing operation by the two-way valve 38, and simultaneously the drain shut-off valve 43 is opened to freely suck the air through the drain tube 42, and the purge cut valve 40 is opened to freely perform the purging.

In the normal purge mode, the evaporative fuel generated in the fuel tank 9 is introduced to the canister 31 through the vapor tube 33 by opening the positive pressure valve 36 of the two-way valve 38 depending on the rise in the tank internal pressure, and is absorbed by the activated charcoal 32. The evaporative fuel thus absorbed is released from the activated charcoal 32 together with the air through the drain tube 42 by the negative pressure in the intake tube 2, and is purged in the intake tube 2 through the purge tube 34. This is the normal purge state in the step S3, and corresponds to the stage of (1) normal operation in FIG. 3.

If the conditions in the step S1 are satisfied, the flow advances to the step S4, in which it is determined whether or not the first timer $_{tm}$PTO becomes "0". Since the first timer $_{tm}$PTO is not "0" in the beginning, the flow advances to a step 5, in which the tank internal pressure is opened to the atmospheric air. Namely, the first solenoid valve 39 is opened to forcibly open the first control valve 35, so that the inside of the fuel tank 9 is communicated to the atmospheric air through the canister 31. This corresponds to the stage of (2) atmospheric opening in FIG. 3.

Subsequently, a second timer $_{tm}$PTD is set to be a second predetermined time T2 (step S6). This time T2 is longer enough, so that if the tank internal pressure $P_T$ is not reduced in a specified reference value $P_{TLVL}$ until an elapse of a specified time after the pressure-reduction treatment is started, it can be determined that there is a leakage in the purge system.

When the atmospheric opening is sufficiently performed by repeating the steps S1, S4 to S6 and thereby the first timer $_{tm}$PTO becomes "0", the flow advances to the step S7.

In the step S7, it is determined whether or not the pressure-reduction treatment is terminated. If not terminated, the flow advances to a step S8.

In the step S8, it is determined whether or not the tank internal pressure $P_T$ is not more than the specified reference value $P_{TLVL}$ (for example, −20 mmHG). Since the tank internal pressure is in the atmospheric opening state in the beginning, the flow advances to a step S9, in which the pressure-reduction treatment is performed.

Namely, the solenoid of the second solenoid valve 43 is energized to close the drain shut-off valve 43, thereby shutting the communication to the atmospheric air through the drain tube 42, as a result of which the canister 31 and the fuel tank 9 are applied with the negative pressure in the intake tube 2 through the purge tube 34, to be thereby pressure-reduced. This corresponds to the stage of (3) pressure-reduction treatment as shown in FIG. 3.

Then, it is determined whether or not the second timer $_{tm}$PTD becomes "0" step S10). If the tank internal pressure $P_T$ is not reduced to a specified reference value $P_{TLVL}$ and the second timer $_{tm}$PTD becomes "0" after an elapse of the second predetermined time T2, there is a fear of leakage of the purge system, and the flow is jumped to a step S15, in which the abnormality is determined. This case is instantly determined to be abnormal. Until an elapse of the second predetermined time T2, the flow advances to a step S11, in which a third timer $_{tm}$PTDC for leak down check is set to be a third predetermined time T3. This time T3 is set at a time required for the leak down check, for example, 30 seconds.

When the tank internal pressure $P_T$ is reduced to the specified reference value $P_{TLVL}$, the flow is transferred from the step S8 to a step S12, in which the termination of the pressure-reduction treatment is set, and advances to a step S13. After the termination of the pressure-reduction treatment is set, the flow directly advances from the step S7 to the step S13. In the step S13, it is determined whether or not the third timer $_{tm}$PTDC becomes "0", so that it is determined whether or not the third predetermined time T3 for leak down check passes away.

Since the third timer $_{tm}$PTDC is not "0" in the beginning, the flow advances to a step S14, in which the leak down is checked. Namely, the purge cut valve 40 is closed, to thereby shut the purge tube 34 for communicating the intake tube 2 to the canister 31. Consequently, the fuel tank 9, vapor tube 33, canister 31, and the upstream portion from the purge cut valve 40 of the purge tube 34 and a canister 31 side portion from the drain shut-off valve 43 of the drain tube 42 form one sealed space, the inside of which is kept in a pressure reduced to the specified pressure.

Accordingly, if there is generated a leakage through a gap present among the piping connections, valves or seals of the fuel tank 9 (for example, filler cap) in the above sealed purge system, the change in the tank internal pressure $P_T$ is enlarged. In the normal state with no leakage from the purge system, there little occurs the change in the tank internal pressure $P_T$ as shown by the two dot chain line in the leak down check stage (4) in FIG. 3. On the contrary, if there occurs a leakage, the change in tank internal pressure $P_T$ is enlarged as shown in the solid line. Thus the abnormality of the purge system can be determined.

In the leak down check stage, when the third timer $_{tm}$PTDC becomes "0" after an elapse of the third predetermined time T3 for leak down check, the flow advances from the step S13 to the step S15, in which the abnormality is determined.

The abnormality is determined by whether or not the tank internal pressure $P_T$ is larger than an abnormality judgment value $P_{TJDG}$ (for example, −10 mmHg). If larger, it is determined that a large amount of the evaporative fuel is leaked. Thus, the purge system is determined to be abnormal. If being smaller, the purge system is determined to be normal.

Also, the abnormality determination may be based on the change rate of the tank internal pressure $P_T$ other than the tank internal pressure $P_T$.

The diagnosis for the purge system is thus performed, and then the flow advances to a step S16. After that, the control for re-starting the purge according to the present invention is made.

Namely, in the step S16, it is determined whether or not the present loop is the first loop to pass through the step 15. If being the first loop, the flow advances to a step S17, in which the fourth timer $_{tm}$PC is set at a fourth predetermined time T4, to thus terminate the route. If being not the first loop, the flow advances to a step S18, in which the drain shut-off valve 43 is opened, and the inside of the canister is opened to the atmospheric air.

Then, in the next step S19, it is determined whether or not the fourth timer $_{tm}$PC becomes "0". Since the fourth timer $_{tm}$PC is not "0" in the beginning, the route is terminated, to be in the waiting state until the fourth predetermined time T4 passes away.

The fourth predetermined time T4 is a time elapsing from the time when the inside of the canister is opened to the atmospheric air to the time when the vapor in the canister is returned in the fuel tank so that the concentration of the evaporative fuel in the canister is reduced and the effect on the air-fuel ratio dependant on the purging fuel vapor is made smaller.

When the fourth timer $_{tm}$PC becomes "0" after an elapse of the fourth determined time T4, the flow advances from the step 19 to a step S20, in which the purge cut valve 40 is opened to thus stop the purge cut, and the flow advances to the step S3 (normal purge control).

Accordingly, even if the purge cut valve 40 is opened, low concentration of the evaporative fuel is purged, thereby eliminating the rapid change in the air-fuel ratio, which makes it possible to keep the emission and the drivability in the stable state.

The above fourth determined time T4 is determined according to the operational state of the engine. In the state liable to generate the evaporative fuel in high rotation and in low load, that is, in the state of a high engine rotational speed $N_e$, or in the state of a high coolant temperature $T_W$ and a high intake air temperature of the engine, the fourth predetermined time T4 is set to be longer. Accordingly, the evaporative fuel in the purge system is absorbed by the absorbing agent for a long period, thereby reducing the concentration of the evaporative fuel, which makes it possible to exert little effect on the air-fuel ratio dependant on purging furl vapor.

Figure 4:
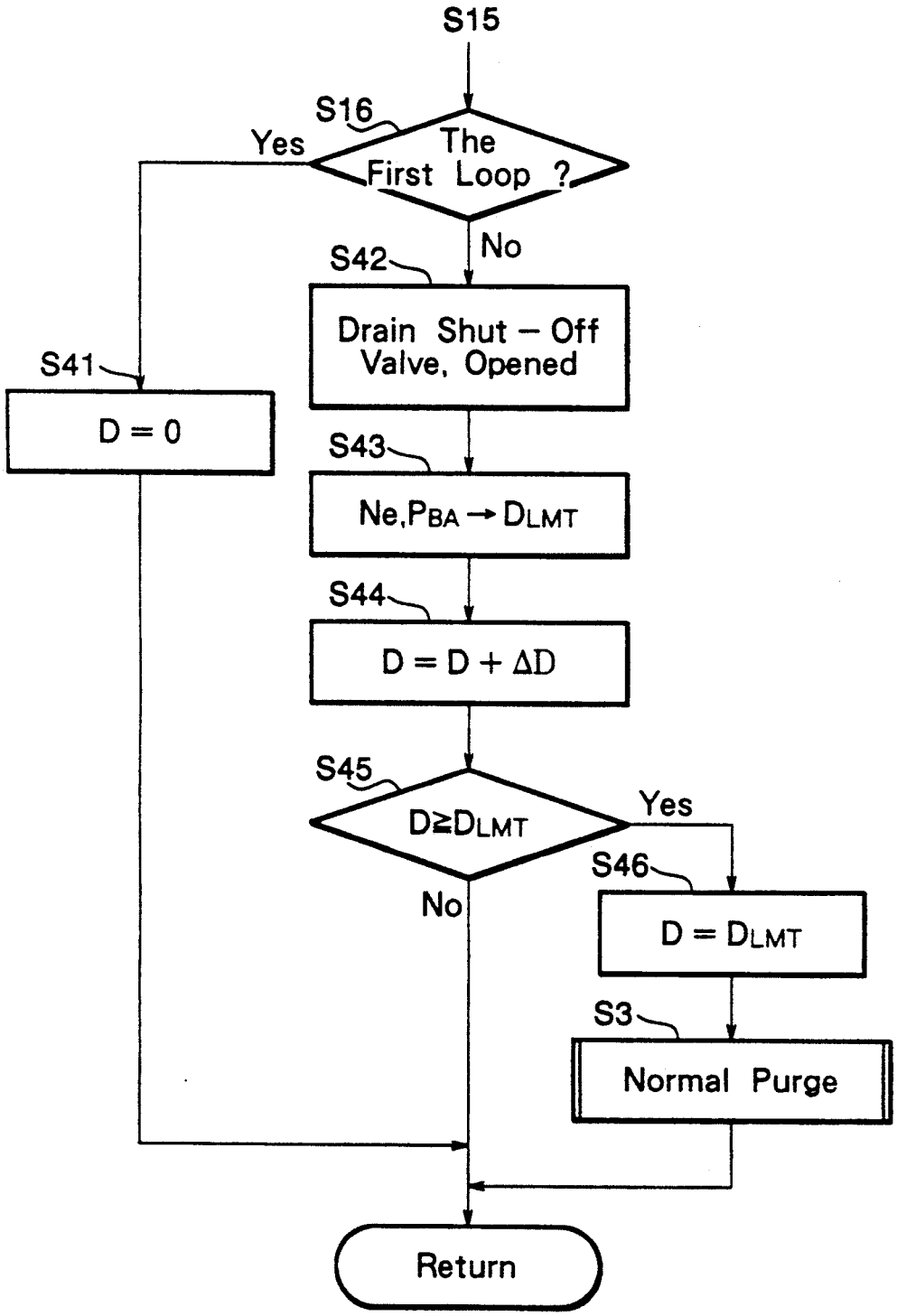
FIG. 4 is a partial flow chart showing a modified part of FIG. 2.

In the above-described diagnostic routine of the purge system shown in FIG. 2, steps after the step S16 may be modified as shown in FIG. 4. In this case, the purge cut valve 40 has a duty solenoid and a duty ratio D thereof is determined based on operational conditions of the engine.

If the present loop is the first loop at the step 16, the flow advances to a step 41, in which the duty ratio D is set to be zero, and then returns. If the loop is not the first loop, the drain shut-off valve is opened (step S42). Then, a limit value of the duty ratio $D_{LMT}$ is obtained by referring a table or map based on the engine rotational speed Ne and the intake absolute pressure $P_{BA}$ (Step S43), and a new duty ratio D is set by adding a value $\Delta D$ to the last value of the duty ratio D (step S44). The value $\Delta D$ is set to be smaller as the operational condition of the engine is more liable to generate the fuel vapor. The new duty ratio D is compared with the limit value $D_{LMT}$ at step S45. If $D<D_{LMT}$, the flow returns. If $D \geqq D_{LMT}$, the flow advances to a step S46 in which D is set to be $D_{LMT}$ and to the step 3 for normal purge.

Thus, variation of the air-fuel ratio dependant on purging high concentration of the evaporative fuel can be inhibited, similarly to the enbodiment shown in FIG. 2.

In the above-described embodiments, the leak is detected by change of the tank internal pressure or the tank internal pressure after an elapse of a predetermined time when the purge system is maintained in a negative pressure state. However, the leakage may be detected by change of the tank internal pressure or the tank internal pressure after an elapse of a predetermined time when the purge system is maintained in a positive pressure state.

Since many changes and modifications can be made to the above-described embodiment of the present invention without departing from the spirit of the present invention, it is intended that all matter contained in the above description and illustrated in the accompanyimg drawings shall be interpreted to be illustrative and not in a limiting sense.

What is claimed is:

1. An evaporative fuel purging apparatus used for an internal combustion engine, comprising:

a purge system comprising a fuel tank and a canister, said canister having an absorbing agent for absorbing an evaporative fuel generated in the fuel tank, and a drain control valve, provided on a drain port for opening said canister to the atmospheric air, which is adapted to open and close said drain port;

a purge control valve provided on a purge passage communicating said canister to a part of an intake system of the internal combustion engine, and which is adapted to control purge of said evaporative fuel absorbed into said canister through said purge passage;

a diagnostic means for diagnosing presence or absence of leakage in the purge system when said drain control valve and said purge control valve are closed; and a purge control means for maintaining said purge control valve in a closed state until a predetermined time elapses after opening of said drain control valve wherein purging of evaporative fuel is inhibited.

2. An evaporative fuel purging apparatus used for an internal combustion engine according to claim 1, wherein said predetermined time is set to be longer with increase in generation of said evaporative fuel.

3. An evaporative fuel purging apparatus used for an internal combustion engine according to claim 1, wherein said predetermined time is set to be longer with increase in an engine coolant temperature.

4. An evaporative fuel purging apparatus used for an internal combustion engine according to claim 1, wherein said predetermined time is set to be longer with increase in an engine load.

* * * * *